US010362640B2

(12) United States Patent
Koós-Varju et al.

(10) Patent No.: US 10,362,640 B2
(45) Date of Patent: Jul. 23, 2019

(54) HEATING ELEMENT POWERED BY ALTERNATING CURRENT AND HEAT GENERATOR ACCOMPLISHED BY THE HEATING ELEMENT

(71) Applicants: János Koós-Varju, Gyöngyöstarján (HU); Zsófia Koós-Varju, Gyöngyöstarján (HU); József Patus, Szigethalom (HU); Attila Jenő Székessy, Kerepes (HU); József Füles, Üllő (HU); Péter ifj. Fűzfa, Budapest (HU); László Gombai, Üllő (HU); Sándor Hajzer, Debrecen (HU); Gábor Váradi, Budapest (HU)

(72) Inventors: János Koós-Varju, Gyöngyöstarján (HU); Zsófia Koós-Varju, Gyöngyöstarján (HU); József Patus, Szigethalom (HU); Attila Jenő Székessy, Kerepes (HU)

(73) Assignees: János Koós-Varju, Gyöngyöstarján (HU); Zsófia Koós-Varju, Gyöngyöstarján (HU); József Patus, Szigethalom (HU); Attila Jeno Székessy, Kerepes (HU); József Füles, Üllo (HU); Péter I F J. Fuzfa, Budapest (HU); László Gombi, üllo (HU); Sándor Hajzer, Debrecen (HU); Gábor Váradi, Budapest (HU)

( * ) Notice: Subject to any disclaimer, the term of this patent is extended or adjusted under 35 U.S.C. 154(b) by 451 days.

(21) Appl. No.: 15/101,272

(22) PCT Filed: Nov. 26, 2014

(86) PCT No.: PCT/HU2014/000113

§ 371 (c)(1),
(2) Date: Jun. 2, 2016

(87) PCT Pub. No.: WO2015/082944

PCT Pub. Date: Jun. 11, 2015

(65) Prior Publication Data

US 2016/0309547 A1 Oct. 20, 2016

(30) Foreign Application Priority Data

Dec. 2, 2013 (HU) ..... 1300697
Dec. 21, 2013 (HU) ..... 1300751

(51) Int. Cl.
*H05B 6/50* (2006.01)
*H05B 6/54* (2006.01)
*H05B 6/62* (2006.01)

(52) U.S. Cl.
CPC ..... *H05B 6/62* (2013.01); *H05B 6/50* (2013.01); *H05B 6/54* (2013.01); *H05B 2203/005* (2013.01)

(58) Field of Classification Search
CPC ..... H05B 3/60; H05B 3/62; H05B 3/64
(Continued)

(56) References Cited

U.S. PATENT DOCUMENTS 3,184,575 A * 5/1965 Sargeant ..... A23L 3/54 159/DIG. 26
4,040,795 A * 8/1977 Jung ..... C03B 5/0338 23/293 R (Continued)

FOREIGN PATENT DOCUMENTS

EP 0 207 329 A1 1/1987
EP 0207329 A1 * 1/1987 ..... H05B 3/60

(Continued)

OTHER PUBLICATIONS

English translation of EP 0207329 A1 Aug. 30, 2018.*

(Continued)

*Primary Examiner* — Dana Ross
*Assistant Examiner* — Joe E Mills, Jr.
(74) *Attorney, Agent, or Firm* — Birch, Stewart, Kolasch & Birch, LLP

(57) ABSTRACT

Heating element (1) powered by alternating current and heat generator (43) comprising the heating element (1) and (Continued)

Figure 1:
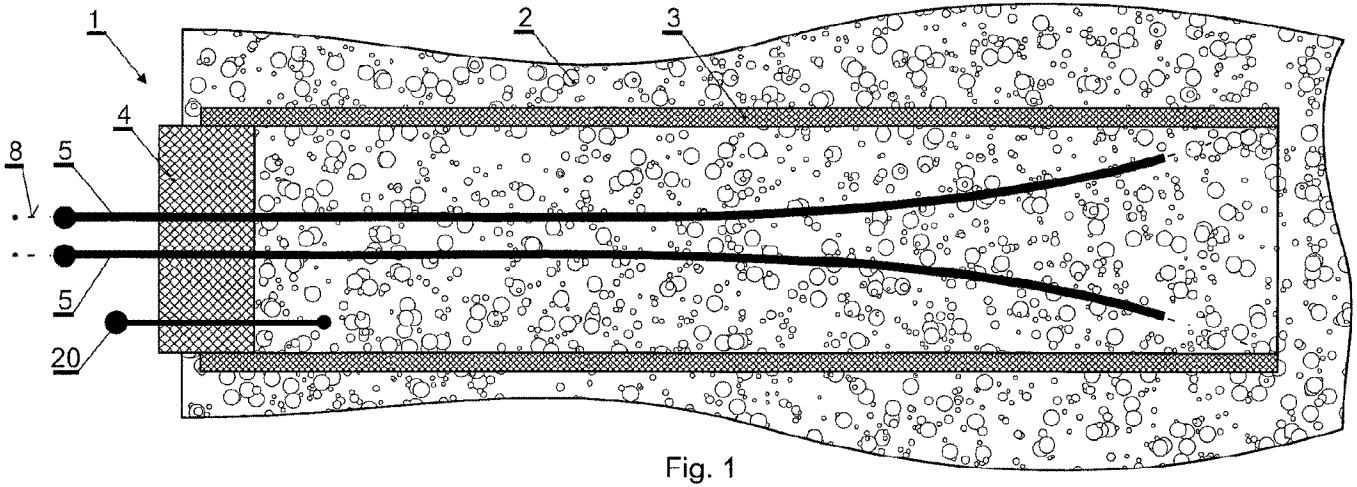

control electronics (9). The heating element has a hollow body housing (3) which is closed or provided with one or more openings, and at least two electrodes (5) which are insulated from said housing (1) and from each other by means of an insulating element (4). The control electronics (9) comprises an AC mains supply unit (10), a central unit (11) and a heavy current switch unit (12). The output (15) of the heavy current switch unit (12) is connected to the heating element (1). The electrodes (5) have a polygonal or a three-dimensional curve cross-section and their longitudinal axes (8) or generating lines each form an exponential curve. A duty factor modulated AC voltage of at most 1000V amplitude, 1000-60 000 Hz is connected to said electrodes (5).

9 Claims, 5 Drawing Sheets

(58) Field of Classification Search
USPC ..... 219/202, 203, 219, 522, 543; 359/838, 359/841, 850, 267; 338/306–309; 392/438–439
See application file for complete search history.

(56) References Cited

U.S. PATENT DOCUMENTS 4,215,233 A * 7/1980 Kastilahn ..... H05B 3/64 188/268
4,322,606 A * 3/1982 Bayly ..... H05B 3/64 174/155
4,956,535 A * 9/1990 Buelt ..... B09C 1/067 166/248
5,120,027 A * 6/1992 Pelton ..... C22B 21/0084 266/200
5,773,797 A * 6/1998 Uemura ..... B24B 49/105 219/628
5,852,284 A * 12/1998 Teder ..... H05B 3/84 219/522
6,135,061 A * 10/2000 Valcic ..... F23D 14/72 122/13.01
6,801,117 B2 * 10/2004 Morris, Jr. ..... H02H 5/042 219/219
7,808,691 B2 * 10/2010 Liu ..... C07D 493/04 359/265
8,031,389 B2 * 10/2011 Wang ..... G02F 1/155 359/265
8,269,153 B2 * 9/2012 Yang ..... H05B 6/108 219/607
8,426,779 B2 * 4/2013 Schlipf ..... H05B 3/48 219/481
8,921,746 B2 * 12/2014 Baarman ..... A45D 40/261 219/660
2001/0045424 A1 * 11/2001 Cooper ..... H05B 3/46 219/543
2002/0047009 A1 4/2002 Flugstad et al.
2009/0183778 A1 * 7/2009 Wildegger ..... B60S 1/487 137/13
2009/0279880 A1 * 11/2009 Belkin ..... F28F 19/00 392/465
2012/0175358 A1 * 7/2012 Davidson, Jr. ..... F01M 5/001 219/202

FOREIGN PATENT DOCUMENTS

GB 844154 8/1960
GB 874958 8/1961

OTHER PUBLICATIONS

International Search Report (PCT/ISA/210) issued in PCT/HU2014/000113, dated May 4, 2015.
Written Opinion (PCT/ISA/237) issued in PCT/HU2014/000113, dated May 4, 2015.

* cited by examiner

HEATING ELEMENT POWERED BY ALTERNATING CURRENT AND HEAT GENERATOR ACCOMPLISHED BY THE HEATING ELEMENT

The invention relates to a heating element powered by alternating current applicable for heating an external medium surrounding the heating element. The heating element has a housing formed as an open or closed hollow body and at least two electrodes which are insulated from the housing and from each other by means of an insulating element. The invention also relates to a heat generator powered by alternating current comprising control electronics and a heating element which is in contact with a heat transferring medium. The control electronics comprises an alternating current mains supply unit, a central unit and a heavy current switch unit. The power output of the mains supply unit is connected to the heavy current switch unit. The frequency output of the mains supply unit is connected to the central unit. The output of the heavy current switch unit is connected to the heating element.

Patent application EP 0690660 describes a method and apparatus for heating a flowing ionic fluid. The apparatus consists of an elongated housing through which the liquid is circulated. At the inlet and outlet of the housing two identical electrodes are arranged. Between the electrodes electric field is generated. During heating the liquid flows between the electrodes. At its centre the housing is constricted to a narrow tube whose cross-section is calculated for the desired rate of flow. In the electrodes perforated discs are arranged in which the number and size of the holes depends on the viscosity and rate of flow. The current density between the electrodes is at most 40 mA/cm$^2$, In this solution the liquid is heated by the two electrodes directly in the flowing substance. It means that continuous flow of the liquid is required for operating the system which naturally may be the heated liquid's own flow. The heated medium is the same as the medium surrounding the electrodes so the type of the heat transferring medium is restricted.

Patent application U.S. Pat. No. 4,072,847 relates to an electric heating element comprising a sealed glass tube containing a sealed tubular structure formed by a metal tube containing an electrical heating element insulated from the metal tube and a plastic tube sealed to one end of the metal tube and containing a thermostat for the heating element.

Patent application US 2002096511 describes a temperature control apparatus for electric heating equipment which can keep the temperature in substantially constant to save energy. The apparatus comprises a relay connected between an AC power supply and the heating equipment, and a central unit for switching the relay. The relay continuously outputs an input AC voltage fed from the AC power supply, or alternatively outputs the input AC voltage intermittently by cutting one cycle of waveform from the waveform of the input AC voltage. The temperature control of the electric heating equipment is effected by controlling the apparent frequency of the input AC voltage to be supplied to the electric heating equipment through adjusting the interval of the waveform.

This solution can be considered energy saving as it keeps the temperature of the heated environment constant, that is, the heating effect is reduced or terminated at certain times. The output is controlled by altering the duty factor. By this the assumed electric power is controlled as a consequence of which the heating effect is changed proportionally. It must be noted that in this solution the duty factor is controlled instead of the frequency. This document is good for controlling the output directly. However, the present invention deals with tuning or maintaining the resonance frequency applied in special environment.

Patent application RU 2189541 describes an ionization technology. Here coaxially mounted phase electrodes and zero electrodes are used. Conduction takes place as a function of the resistance of the flowing medium and the heat produced by the electric current is used. The basic idea is similar to that of the ohmic heaters. The present invention is different from this solution because of the exponential curve shaping. Further, in case of the present invention high-efficiency collisions and friction between the charged ions are utilized which de-emphasizes the ohmic effect and results in intensive heat generation. The invention can be realized at low cost as there is no need for special materials.

Patent application EP 0207329 teaches a method and device for transforming electrical energy into thermal energy. The essential factor here is that a device having a housing, which is externally proofed against pressure and fluids and has a dielectric inside, which consists of a mixture of a high-purity metal and of distilled water or transformer oil. At least one electrode is passed into the inside of the housing with the aid of an insulating duct. If two rod electrodes are used, these are connected to a current source with a control device. If one electrode is used, this and the housing, which then consists of conductive material as the other electrode, are connected to a current source with a control device. The control device controls the current source such that in an initial operating phase the dielectric is excited into vibrations at resonance frequency and such that subsequently only so much energy is supplied as is required to maintain the resonant vibration state of the dielectric. The excitation and energy supply can be provided by means of DC or AC, preferably high-frequency non-sinusoidal AC.

This solution is entirely different from the present invention. They use high frequency and the apparatus is operated at the frequency of the dielectric in the closed space not at the resonance frequency of the cavity. According to the related document two electrodes are used within the housing or one of the electrodes may be the housing itself. The resonance frequency of the dielectric fluid between the two electrodes is determinant. This fluid comprises distilled water containing high-purity metal or can be transformer oil. This fluid is only partially dielectric as it also contains ions. In the solution of the present invention instead of the resonance frequency of the dielectric fluid filling the cavity, the inner space of the housing that is the resonator cavity's resonance frequency is determinant. It means that the housing' essentially functions as resonator cavity and the housing itself or the material within the housing is of no importance. Another significant difference is that the present invention uses an essentially lower frequency.

Patent application US 2009/0263113 describes a method for heating a fluid containing dipolar particles such as molecules or clusters of molecules whereby the fluid is subjected to an electric field in a heat generator causing the particles of the fluid to be oriented according to their charge. The particles are additionally subjected to voltage pulses causing the short-range order of the particles to be destroyed, and the particles of the fluid may be displaced in a resonance vibration by means of voltage pulses. In this manner thermal energy is generated.

The only similarity between the above method and the present invention is that the particles of the fluid are charged and their charge can be changed externally. However, in the solution of the present invention the measure of change does not depend on the applied energy. According to the present invention in a resonant space the amplitude of motion of the already charged particles is modulated and continuously increased with the special electrode arrangement. As a result of it the modulated particles travel along a significantly longer path. In this manner the amount of the necessary and used energy is considerably less.

The object of the present invention is to provide a novel heat generating apparatus the operation of which is based on all the physical laws applied less in earlier times resulting in a significantly increased heating efficiency and which can be used for heaters at homes and also in industrial establishments. A further object is to provide a heat generating apparatus the operation of which can be controlled easily.

It has been realized that motion of the ions in a given medium generates a significant amount of heat. It has also been realized that when the ions in the ion containing medium are excited in an at least partially closed space at a resonance frequency characteristic of the space, a stationary wave is created during the amplitude modulation of the ions set in motion. As a result of this high-efficiency collisions are induced between the ions resulting in active heat generation. To this properly formed oscillators with alternating polarity are needed to be built in the given space. This requires suitably high-efficient oscillator electronics and controller. By using electronics for monitoring and adjusting the modulating frequency the efficiency may further be enhanced as the energy required for reaching the same temperature is significantly less. The energy demand required for this type of heat generation is entirely different from an electrically powered but ohmic heat generator.

In one aspect the present invention is a heating element powered by alternating current applicable for heating the external medium surrounding the heating element. The heating element has a hollow body housing which is a cavity resonator and is closed or provided with one or more openings, and at least two electrodes which are insulated from the housing and from each other by means of an insulating element. Inside the housing of the heating element internal medium containing charged ions is placed. In case of an open housing the internal medium is identical with the external medium, and in case of a closed housing it is identical with or different from the external medium. The electrodes have a polygonal or a three-dimensional curve cross-section. The electrodes are placed in the housing in such a manner that their longitudinal axes each shaped as an exponential curve are divergent, i.e. the distance between their longitudinal axes grows exponentially. In another embodiment the electrodes are formed as a section of the sheath of a body of revolution the generating lines of which is each shaped as an exponential curve diverging from their axis of rotation i.e. the distance between the generating lines grows exponentially. A duty factor modulated AC voltage of at most 1000 V amplitude, 1000-60 000 Hz is connected to the electrodes and the required value of the frequency and amplitude of the AC voltage as well as the size of the electrodes are determined in a known manner in order to operate the housing of the heating element at resonance frequency.

In another aspect the invention is a heat generator powered by alternating current comprising control electronics and a heating element which is in contact with a heat transferring medium. The heating element has a housing formed as an open or closed hollow body and at least two electrodes which are insulated from the housing and from each other by means of an insulating element. The control electronics comprises an alternating current mains supply unit, a central unit and a heavy current switch unit. The power output of the mains supply unit is connected to the heavy current switch unit. The frequency output of the mains supply unit is connected to the central unit. The output of the heavy current switch unit is connected to the heating element. Inside the housing of the heating element internal medium containing charged ions is placed. In case of an open housing the internal medium is identical with the external medium, and in case of a closed housing it is identical with or different from the external medium.

The electrodes have a polygonal or a three-dimensional curve cross-section. The electrodes are placed in the housing in such a manner that their longitudinal axes each shaped as an exponential curve are divergent, i.e. the distance between their longitudinal axes grows exponentially. In another embodiment the electrodes are formed as a section of the sheath of a body of revolution the generating lines of which is each shaped as an exponential curve diverging from their axis of rotation i.e. the distance between the generating lines grows exponentially. A duty factor modulated AC voltage of at most 1000 V amplitude, 1000-60 000 Hz is connected to the electrodes and the required value of the frequency and amplitude of the AC voltage as well as the size of the electrodes are determined in a known manner in order to operate the housing of the heating element at resonance frequency. The central unit of the control unit consists of a modulation summator and a base frequency generator. Basically, the base frequency generator is a square wave generator provided with an automatic frequency comparator unit. One of the input signals of the comparator unit is the base frequency signal of the base frequency generator, and its other input signal is the temperature reference signal fed back from the heating element. The output signal of the base frequency generator is a square wave which substantially corresponds with the resonance frequency and which is connected to a first input of the of the modulation summator. The frequency output of the mains supply unit is connected to the second input of the modulation summator of the central unit. The output of the modulation summator is connected to the control input of the heavy current switch unit.

In order to operate the invention in an advantageous manner adjustment of three variables and pre-calculation of the resonance point are required. One of the three variables, namely the conductance of the internal medium must be set to a proper value before starting the operation while the current and the temperature must be set during operation.

Preferred embodiments of the invention will be defined by the appended claims.

Figure 2:
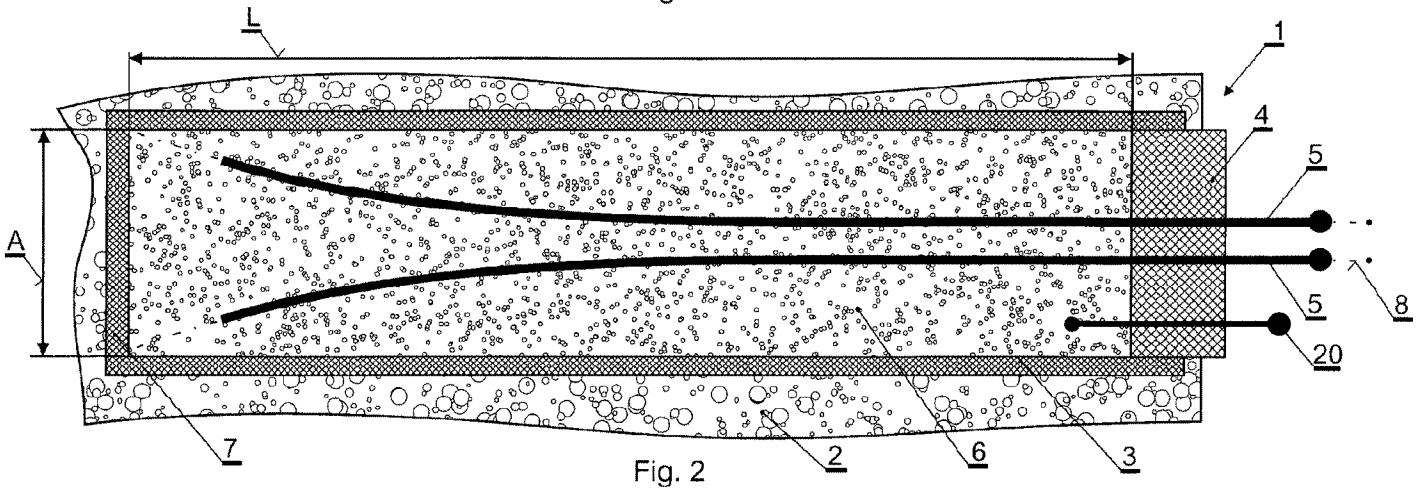
Figure 3:
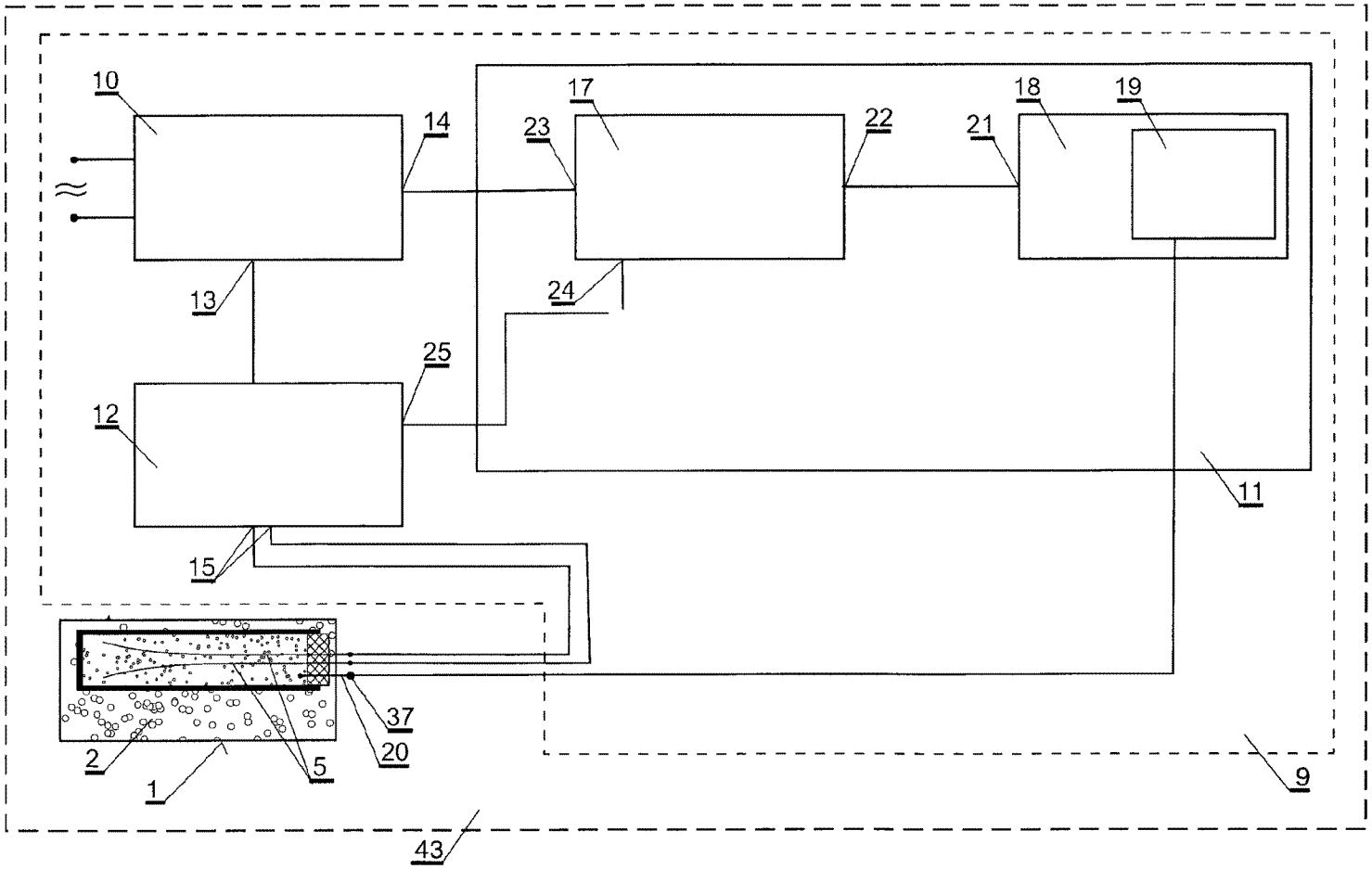
Figure 4:
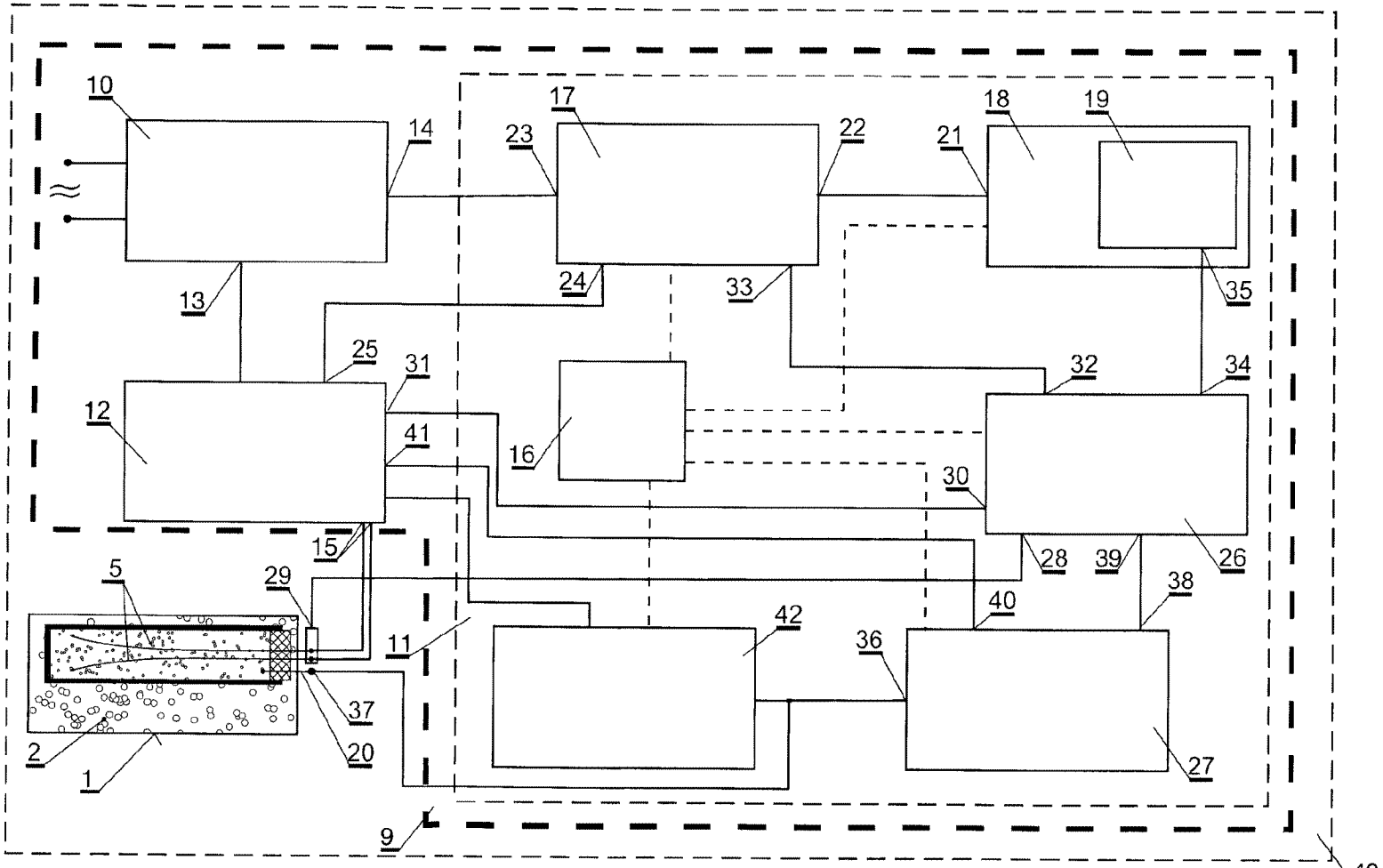
Figure 5:
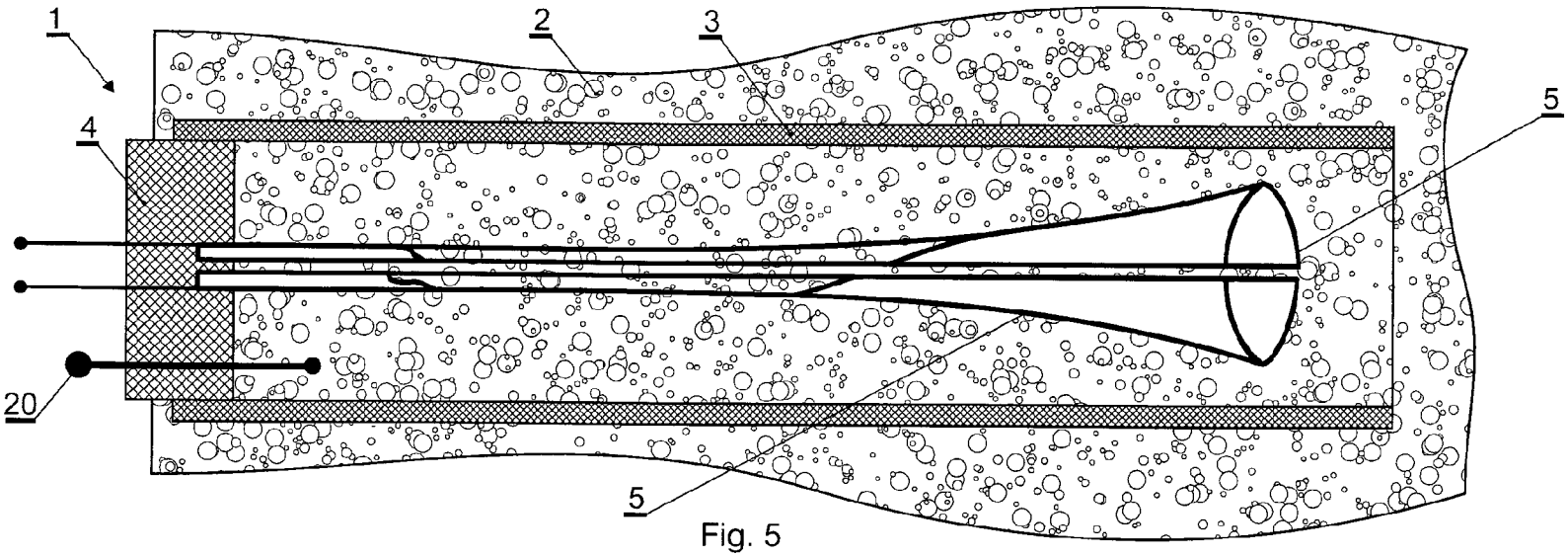
Figure 6:
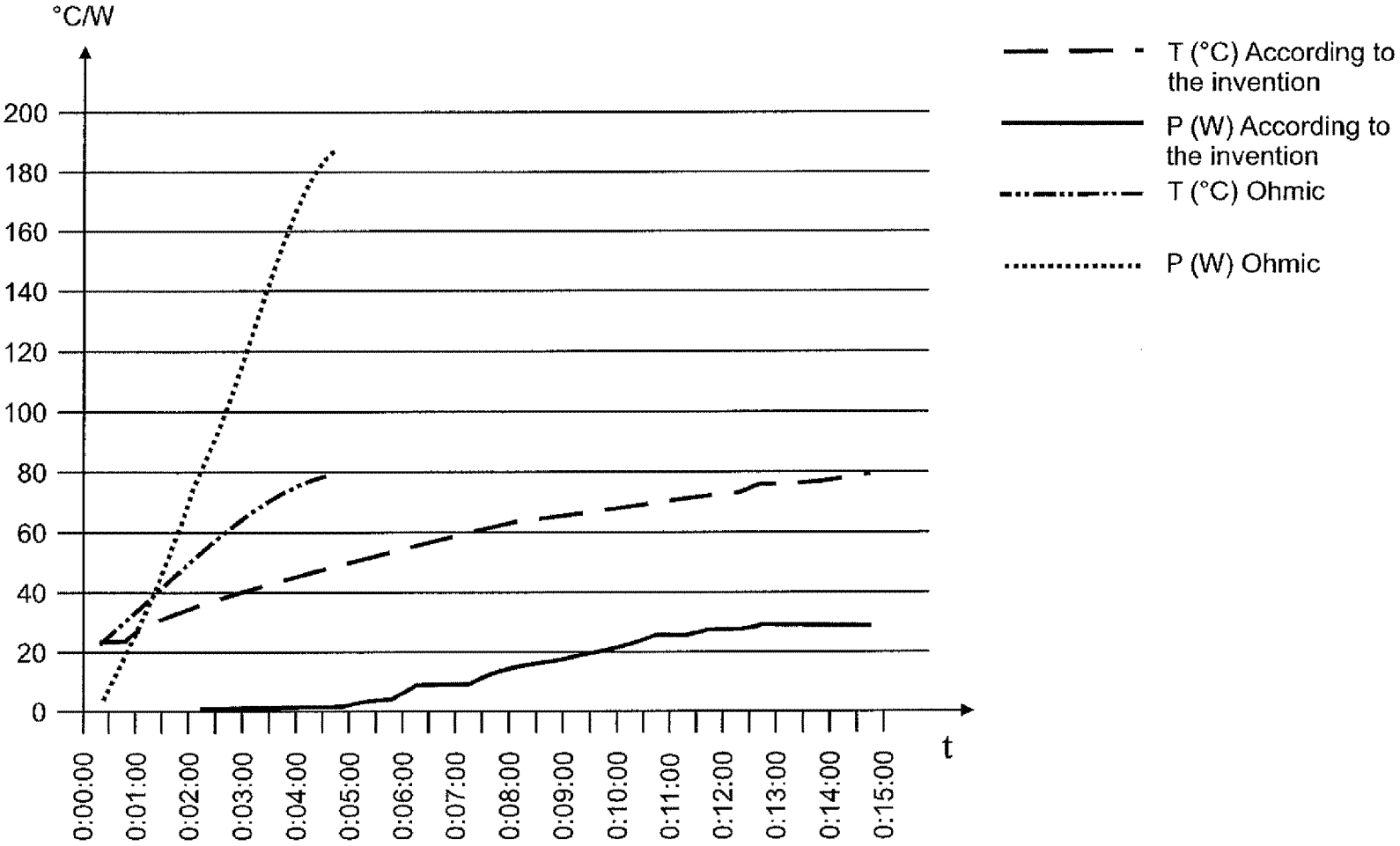

Detailed description of preferred embodiments of the invention will be given with reference to the accompanying drawings in which:

FIG. 1 is the sectional side view of the heating element with an open end,

FIG. 2 is the sectional side view of the heating element with a closed end wherein the heating element is filled with internal medium, FIG. 3 is a block diagram showing a possible embodiment of the control electronics, FIG. 4 is a block diagram showing a possible embodiment of the heat generator, FIG. 5 shows a partially sectional view of the heating element provided with an electrode formed as a body of revolution, and FIG. 6 is a graph showing the temperature/power of the heat generator according to the invention as compared to that of the ohmic apparatuses, wherein the horizontal axis shows the time elapsed in minutes and the vertical axis shows the temperature/power ratio.

The AC powered heating element 1 according to the invention is used for heating the external medium 2 surrounding it. The heating element 1 comprises a hollow body housing 3 which is a cavity resonator and is formed with one or more openings (FIG. 1) or a closed housing 3 (FIG. 2), and at least two electrodes 5 which are insulated from the housing 3 and from each other by means of an insulating element 4 made of a suitably solid material which is chemically resistant to the medium. The material of the insulating element 4 has high electrical and thermal insulating capability and suitably solid for keeping the waves generated during operation in the inner space of the housing 3. The closed hollow body housing 3 can be formed in one piece e.g. a tube which is closed by a closing element 7. Housing 3 is an optional body of revolution, preferably a tube. Inside the housing 3 of the heating element 1 internal medium 6 containing charged ions is placed which is identical with the external medium 2 in case of an open housing 3. In case of a closed housing 3 it can be identical with or different from the external medium 2. In this latter case it is not necessary for the external medium 2 to contain charged ions. The material of the housing 3 can be e.g. metal or plastic or multi-layer plastic which is chemically resistant to the internal medium 6 and the external medium 2, has high thermal conductivity and radio frequency shielding capacity.

The electrodes 5 have a polygonal or a three-dimensional curve cross-section. Their longitudinal axes 8 each shaped as an exponential curve are divergent, i.e. the distance between their longitudinal axes 8 grows exponentially. In another embodiment the electrodes 5 are formed as a section of the sheath of a body of revolution the generating lines of which is each shaped as an exponential curve diverging from their axis of rotation i.e. the distance between the generating lines grows exponentially. At most 1000 V amplitude, 1000-60 000 Hz, duty factor modulated AC voltage is connected to the electrodes 5. The value of the frequency and amplitude of the AC voltage as well as the size of the electrodes 5 for operating the housing 3 of the heating element 1 at the required resonance frequency are determined in a known manner e.g. using Helmholtz resonator calculation. Helmholtz resonator is an acoustic resonator consisting of a tube and a cavity. Practically it is the acoustic equivalent of the LC circuit. Geometric measurements are used for tuning the resonator. The resonance frequency is generated on the basis of Thomson-formula.

The material of the electrodes 5 is some resilient, highly conductive, corrosion resistant metal which is not exclusively formed as a plate. Their task is to transmit the required electric power at the required frequency to the internal medium 6 containing the charged ions. They are typically shaped as an exponentially diverging curve as this shape is more effective. However, other shaping is also feasible. The length of the electrodes 5 is determined on the basis of the resonance frequency characteristic of the cavity resonators. Their number is minimum two.

When polarity of electrodes 5 changes oppositely the ions change direction and move towards the opposite charge resulting in an enhanced heat generation. Intense heat generation and minimum gasification in case of certain fluids—like the medium containing charged ions—can only and exclusively be ensured by supplying alternating current.

During the amplitude modulation of the ions set in motion at a frequency characteristic of the resonant space in the cavity of housing 3 of the heating element 1 a stationary wave is generated. As a result of this high-efficiency collisions are induced between the moving, charged ions resulting in active heat generation and typically more heat can be generated than with like ohmic heat generating apparatuses while using the same amount of energy.

On the basis of the exponentially diverging curved shape and the alternating voltage control of the electrodes 5—in consequence of which the polarity on the pair of electrodes 5 continuously changes—amplitude modulation is induced. As a result of this the oscillating ions travel along a continuously longer path between the two electrodes 5 to the inner end of electrodes 5.

During the longer and pulsating motion enhanced friction of ions is caused resulting in a greater amount of heat generation in the given medium. The tuned cavity, in this case the inner space of housing 3 is resonance tuned. The value of the resonance frequency is determined by the inner length L and inner cross-section A of housing 3 (FIG. 2). The resonance frequency and/or the capacitive factor $C_a$ of the housing is determined in a known manner through relations used for acoustic systems. On the basis of these values the constant multiplier of the function defining the exponential curve of the electrodes 5 can be determined in the known manner. To this wide-ranging technical literature is available from which both Helmholtz and Thomson relations can be learned. The applicable relation:

$$\omega_0 = \frac{1}{\sqrt{m_a C_a}}$$

$$m_a = \frac{1}{\omega_0^2 C_a}$$

Wherein $m_a$ is the multiplier of the exponential function, that is, in the present example the known exponential function determining the shape of the electrodes 5 is $y=m_a \times a^x$ in which y is the active length of the longitudinal axis 8 or generating line of electrode 5. The value of $a^x$ should be chosen in such a manner that electrode 5 does not contact with the inner wall of housing 3.

The resonance frequency may be determined by measurement in such a manner that the frequency applied at the minimum current taken for operating the heating element 1 is the resonance frequency $\omega_0$. As heating element 1 is operated at a resonance frequency determined by the physical size of the housing 3 a stationary wave is generated. Because of this stationary wave the energy required for maintaining the process started by the motion of the ions is less than in case of conventional electric heaters. When the control frequency falls outside the range of the resonance frequency belonging to a given housing 3 the mentioned effects cannot be observed. The highest efficiency of the system can be obtained near resonance frequency $\omega_0$.

External medium 2 is fluid or a suitably consistent gel or solid material. The internal medium 6 is some highly heat-conductive and heat-transmitting fluid or a suitably consistent gel or solid material containing charged ions. A suitable material for internal medium 6 or for external medium 2 when they are the same is fluid or some solid state material or gel which contains charged ions and has high heat-conductive properties. Preferably, liquid state material is used as internal medium 6 in order to generate an appropriate stationary wave. The task of it in the system is to provide the charged ions during operation which start oscillating and moving due to the supplied energy. Within the material the friction of ions during their motion generates heat which is transmitted to the surface of housing 3.

An insulating element 4 is hermetically fixed to housing 3. A temperature reference signal sensor 20 is led through the insulating element 4 and is connected to temperature output 37 for adjusting, readjusting the resonance frequency. The connectors of electrodes 5 transmit the transformed electric energy to electrodes 5 of the heating element 1 through galvanic connection with little loss. The connector should be highly conductive electrically; its material should be suitably solid and have resilient structure so that the galvanic connection does not disengage due to the oscillation of electrodes 5 during operation. This would lead to increased resistance which would result in reduced conduction.

The housing 3 may have a circular or polygonal cross-section or it may have ribs wherein the ribbing is formed as waves or angular teeth. The electrodes 5 are placed in the tubular housing 3 in such a manner that their longitudinal axes each shaped as an exponential curve are divergent, i.e. the distance between their longitudinal axes grows exponentially (FIGS. 1, 2). In another embodiment the electrodes 5 having the shape of a body of revolution are placed concentrically and each of their generating lines is shaped as an exponential curve diverging from their axis of rotation i.e. the distance between the generating lines grows exponentially (FIG. 5). The electrodes 5 are formed from resilient, highly conductive sheet-metal which is chemically resistant to medium 2, 6.

To sum it up, the material of the housing 3 of the heating element 1 may be any kind of highly heat-conductive material for example metal, plastic or multi-layer plastic which is chemically less affine (but not exclusively corrosion resistant) to the medium containing the charged ions. Its high heat-conductivity ensures that transfer of the heat generated within the resonator takes place rapidly and only with a slight heat-loss. It may be cylindrical or may have a prismatic cross-section. In terms of wave propagation cylinder form housing is proposed. The outer surface of it may be ribbed in order to ensure the good heat-transfer but typically it has no influence on the operation. The material of the housing 3 should have high shielding capacity against radio frequency. With respect to frequency and power the size of the housing can be determined by known formulas used for calculations of cavity resonators.

Heating elements powered by alternating current is operated by control electronics 9. In an advantageous embodiment the control electronics 9 (shown by the dashed lines in FIG. 3) comprises a mains supply unit 10, a central unit 11 and a heavy current switch unit 12.

Mains supply unit 10 supplies the power for the heat producing process. It is provided with a noise filter for filtering the interfering signals arriving from the electric network and to prevent the interfering signals of the central unit 11 from getting back to the network. Further, it is provided with electric and/or mechanical fuse to protect central unit 11, heavy current switch unit 12 and electrodes 5.

The power output 13 of mains supply unit 10 is connected to heavy current switch unit 12. The frequency output 14 of mains supply unit 10 is connected to central unit 11. The output 15 of the heavy current switch unit 12 is connected to heating element 1.

Central unit 11 comprises modulation summator 17 and base frequency generator 18. The signal generated by the base frequency generator 18 is modulated with the frequency of the network by modulation summator 17. The task of the modulation summator 17 is the phase-correct matching of the base frequency to the frequency of the network, wherein the frequency of the network is 50-60 Hz, the base frequency is 1000 Hz-60 000 Hz (according to the resonance frequency characteristic of the housing 3 of the heating element 1). The duty factor of the signal is 1-100% (the duty factor greatly depends on the medium containing the charged ions). The operating voltage range is 110 V-1000 V. Preferably less than 400 V is applied. In some particular cases, when the conductivity of the ionic medium is low, more than 400 V may be used. However, because of the nearness of the electrodes 5 and in those cases when the medium is highly conductive, electric arc may be created which must be avoided for safety reasons.

The base frequency generator 18 is substantially a square wave generator provided with automatic frequency comparator unit 19.

The base frequency generator 18 is a stable square wave generator containing an AFC (Automatic Frequency Comparator) unit which is applicable to compensate the base frequency needed for the resonance frequency on the basis of the temperature measured by sensor 20 of heating element 1 and fed back through temperature output 37. This is required since the resonance frequency continuously changes during the temperature change of the medium containing the charged ions.

One of the input signals of the comparator unit 19 is the base frequency signal of the base frequency generator 18, and its other input signal is the reference signal fed back from the heating element 1, that is, the signal of sensor 20 transmitted at the temperature output 37.

Output signal 21 of the base frequency generator 18 is a square wave having a frequency substantially correspondent to the resonance frequency and it is transmitted to the first input 22 of modulation summator 17. Frequency output 14 of mains supply unit 10 is connected to the second input 23 of the modulation summator 17. Output 24 of the modulation summator 17 is connected to the control input 25 of heavy current switch unit 12.

The heavy current switch unit 12 transmits the mains current from the mains supply unit 10 to electrodes 5 through output 15 according to the modulated signal transmitted to its control input 25. Advantageously it is performed by thyristor or other similar known switching technology.

In a more compound embodiment of control electronics 9 the central unit 11 contains the control unit 16 (framed by thick dashed lines in FIG. 4).

Control unit 16 controls modulation summator 17 and base frequency generator 18. Control electronics 9 also contains a current sensing and controlling unit 26 for sensing the current of heating element 1 and a temperature sensing and controlling unit 27 for sensing the temperature of heating element 1. Current sensing and controlling unit 26 and temperature sensing and controlling unit 27 are also controlled by control unit 16.

Current sensing and controlling circuit 26 controls the volume of current on electrodes 5 on the basis of the set reference value and the value measured and sensed during operation.

Temperature sensing and controlling circuit 27 is applicable to sense the temperature of heating element 1 and on the basis of the set and sensed values it controls, switches on and off the current on electrodes 5 according to predetermined values fixed in a matrix. In this embodiment heating element 1 is also provided with a current output 29 for measuring the current on heating element 1. Further, the temperature output 37 of sensor 20 is connected to the base frequency generator 18 through temperature sensing and controlling circuit 27 and current sensing and controlling circuit 26.

A first input 28 of the current sensing and controlling circuit 26 is connected to the current output 29 of heating element 1. A first output 30 of the current sensing and controlling circuit 26 is connected to the current input 31 of heavy current switch unit 12, its second output 32 is connected to the third input 33 of modulation summator 17, and its third output 34 is connected to the current input 35 of base frequency generator 18. Input 36 of temperature sensing and controlling circuit 27 is connected to the temperature output 37 of heating element 1. Its first output 38 is connected to the second input 39 of the current sensing and controlling circuit 26, its second output 40 is connected to the temperature input 41 of the heavy current switch unit 12. Through this arrangement the required value of resonance frequency is ensured during control in terms of temperature and current consumption of heating element 1. The lowest energy consumption can be achieved by operating heating element 1 at the resonance frequency that is, the minimum current consumption can be set to the required temperature.

For safety reasons an overheat protection circuit 42 is connected between heating element 1 and heavy current switch unit 12.

Preferably, control unit 16 is realized by microprocessor circuit running a suitable control program. Modulation summator 17, base frequency generator 18, current sensing and controlling circuit 26 and temperature sensing and controlling circuit 27 may also be embodied by a so-called microcontroller or other control units used in computer technology running a certain unique program.

The heat generator 43 according to the invention comprises heating element 1 and control electronics 9. A simple embodiment of the invention is shown in FIG. 3. In this solution the heating element 1 filled with internal medium 6 and connected to control electronics 9 described with reference to FIG. 3 is placed in the proper external medium 2. Naturally, the external medium is contained in an apparatus producing thermal energy. In this case too, the internal medium 6 may be identical with the external medium 2.

A more complicated embodiment of the heat generator 43 according to the invention is shown in FIG. 4. In this embodiment the heating element 1 filled with internal medium 6 and connected to control electronics 9 described with reference to FIG. 4 is placed in the proper external medium 2. Naturally, the external medium is contained in an apparatus producing thermal energy. In this case too, the internal medium 6 may be identical with the external medium 2.

When greater amount of heat is required and in cases when the physical dimensions are limited or number of power-levels is needed to be used, several heating elements may be applied as in terms of resonance each of the heating elements is an independent unit. However, each of the heating elements 1 must be provided with respective control electronics 9. Otherwise, it is possible to increase the dimension, but in each case, the physical laws relating to cavity resonators must be considered. The graphs of FIG. 6 show the temperature/power consumption of an electric oil radiator provided with an ohmic heating element available at the market as compared to the temperature/power consumption of the same type of radiator but provided with the heat generator 43 according to an embodiment of the invention taken as a function of time. In the Figure the continuous line shows the power consumption of the heat generator 43 according to the invention as a function of time to reach a surface temperature of 80° C. of the oil radiator. To this 15 minutes and a power of 30 W were needed. The dotted line shows the power consumption of the customary ohmic apparatus as a function of time to reach the surface temperature of 80° C. To this 4.5 minutes and a power of 190 W were needed. It is clear that the solution according to the present invention used less than one sixth of the power used by the ohmic apparatus. This ratio remains,the same while the temperature is maintained. The heat generator 43 according to the invention can be realized e.g. in the following manner. The heating element 1 according to the invention can be built in for example in the lower threaded joining part of an oil radiator after the original ohmic heating element is removed. Heating element 1 extends in the housing of the radiator approximately as far as one-third of it. Three-fourths of the radiator is filled with common tap water. In this case the heat transferring external medium 2 between the radiator body and the heating element 1 is common tap water. The radiator is provided with a tap for filling and draining. The air cushion above the external medium behaves as an expansion tank. The heat generation causes gravitational motion of the external medium 2 as a result of which each of the radiator elements and almost its entire surface is heated up. Control electronics 9 is accomplished and connected to the heating element 2 as it has already been described. The electric power for operating control electronics 9 is supplied by the electric network. Control electronics 9 may be placed on the wall or may be mounted on the radiator in a closed insulated box designed for this purpose. A room thermostat may be connected to the apparatus if required to further improve the efficiency of the used energy.

The heating element and heat generator of the invention have several advantages. It can be manufactured easily, there is no need for special materials, and all the component parts are easily obtainable. During operation there is no combustion products, no carbon-monoxide at the site of application, in this manner there is no risk of explosion and poisoning, so it is environment friendly and safe. It can be installed quickly and cheaply. Its operation is highly efficient and it can be used widely, maintenance requirement of the apparatus is minimal. As opposed to known technical solutions the solution of the present invention saves a significant fossil energy for generating a unit of thermal energy. It is suitable for any kind of apparatuses needed for generating thermal energy and are used for heating or cooling.

For example:

a) It can be used for heating family houses, holiday homes, offices, industrial establishments, hotels, shopping malls with radiators and furnaces, for heating caravans with radiators.

b) It can be used for heating pools, aqua parks, for electric car heating systems, for green houses, can be used in livestock farms, for ship heating systems.

c) It can be used for hot water supply.

d) It can be used for absorption cooling technology, for refrigerators, air-conditioners, cold-storage houses, industrial refrigerators.

The invention claimed is:

1. A heating element (1) powered by alternating current for heating an external medium (2) surrounding it, the external medium being fluid or suitably consistent gel or solid material, said heating element (1) has a hollow body housing (3) which is closed or provided with one or more openings, and at least two electrodes (5) which are insulated from said housing (1) and from each other by means of an insulating element (4) characterized in that said housing (3) of said heating element (1) is a cavity resonator in which an internal medium (6), which is a highly heat-conductive and heat-transmitting fluid or a suitably consistent gel or solid material, containing charged ions is placed which in case of an open housing (3) is identical with said external medium (2) and in case of a closed housing (3) it is identical with or different from said external medium (2); said electrodes (5) have a polygonal or a three-dimensional curve cross-section and they are placed in said housing (3) in such a manner that their longitudinal axes (8) each having a shape of an exponential curve diverge from each other, or said electrodes (5) are formed as a section of the sheath of a body of revolution the generating lines of which is each shaped as an exponential curve diverging from their axis of rotation; a duty factor modulated AC voltage source of at most 1000V amplitude, 1000-60 000 Hz is connected to said electrodes (5) and the required value of the frequency and amplitude of the AC voltage source as well as the size of said electrodes are determined in a known manner in order to operate said housing (3) of said heating element (1) at resonance frequency.

2. The heating element according to claim 1 characterized in that said housing (3) is an optional body of revolution in the shape of a tube, the material of which is preferably metal, plastic or multi-layer plastic which is chemically resistant to said internal medium (6) and said external medium (2) and has high thermal conductivity and radio frequency shielding capacity.

3. The heating element according to claim 1 characterized in that said insulating element (4) is hermetically fixed to said housing (3) and is made of a suitably solid material which is chemically resistant to said medium and a temperature reference signal sensor (20) is led through said insulating element (4).

4. The heating element according to claim 1 characterized in that said housing (3) has a circular or polygonal or ribbed cross-section wherein the ribbing is formed as waves or angular teeth.

5. The heating element according to claim 1 characterized in that said electrodes (5) are formed from resilient, highly conductive sheet-metal which is chemically resistant to said medium (2, 6).

6. A heath generator (43) powered by alternating current comprising control electronics (9) and a heating element (1) which is in contact with a heat transferring medium namely an external medium (2), the external medium being fluid or suitably consistent gel or solid material, said heating element (1) has a housing (3) formed as an open or closed hollow body and at least two electrodes (5) which are insulated from said housing (3) and from each other by means of an insulating element (4), said control electronics (9) comprises an alternating current mains supply (10), a central unit (11) and a heavy current switch (12), the power output (13) of said mains supply (10) is connected to said heavy current switch (12), the frequency output (14) of said mains supply (10) is connected to said central unit (11), and the output (15) of said heavy current switch (12) is connected to said heating element (1) characterized in that said housing (3) of said heating element (1) is a cavity resonator in which internal medium (6), which is a highly heat-conductive and heat-transmitting fluid or a suitably consistent gel or solid material, containing charged ions is placed, which in case of an open housing (3) is identical with the external medium (2), and in case of a closed housing (3) it is identical with or different from the external medium (2); said electrodes (5) have a polygonal or a three-dimensional curve cross-section, and they are placed in said housing (3) in such a manner that their longitudinal axes (8) each having a shape of an exponential curve diverge from each other, or said electrodes (5) are formed as a section of the sheath of a body of revolution the generating lines of which is each shaped as an exponential curve diverging from their axis of rotation; a duty factor modulated AC voltage source of at most 1000 V amplitude, 1000-60 000 Hz is connected to said electrodes (5) and the required value of the frequency and amplitude of the AC voltage source as well as the size of said electrodes are determined in a known manner in order to operate said housing (3) of said heating element (1) at resonance frequency; said central unit (11) of said control unit (9) consists of a modulation summator (17) and a base frequency generator (18), said base frequency generator (18) is a square wave generator provided with an automatic frequency comparator unit (19), one of the input signals of said comparator unit (19) is the base frequency signal output from said base frequency generator (18) and its other input signal is the signal of the temperature reference signal sensor (20) fed back from said heating element (1); the output signal (21) of said base frequency generator (18) is a square wave which corresponds with the resonance frequency and which is connected to a first input (22) of said modulation summator (17) while the frequency output (14) of said mains supply (10) is connected to the second input (23) of said modulation summator (17) of said central unit (11), the output (24) of said modulation summator (17) is connected to the control input (25) of said heavy current switch (12).

7. The heat generator according to claim 6 characterized in that said central unit (11) comprises a control unit (16), for operating said modulation summator (17) and said base frequency generator (18), said control unit (16) also operates a current sensing and controlling circuit (26) which senses and controls the current of said heating element (1) and a temperature sensing and controlling circuit (27) which senses and controls the temperature of said heating element (1), a first input (28) of said current sensing and controlling circuit (26) is connected to a current output (29) of said heating element (1), a first output (30) of said current sensing and controlling circuit (26) is connected to a current input (31) of said heavy current switch (12), its second output (32) is connected to a third input (33) of said modulation summator (17), and its third output (34) is connected to a current input (35) of said base frequency generator (18); an input (36) of said temperature sensing and controlling circuit (27) is connected to a temperature output (37) of said heating element (1), a first output (38) of said temperature sensing and controlling circuit (27) is connected to a second input (39) of said current sensing and controlling circuit (26), and its second output (40) is connected to a temperature input (41) of said heavy current switch (12).

8. The heat generator according to claim 6 characterized in that an overheat protection circuit (42) is connected between the heating element (1) and the heavy current switch (12).

9. The heat generator according to claim 6 characterized in that said control unit (16) a microprocessor circuit.

* * * * *